United States Patent [19]

Manuel

[11] 4,367,894

[45] Jan. 11, 1983

[54] FOLDABLE DENTAL CHAIR

[76] Inventor: John L. Manuel, 960 Alexander Dr., Haysville, Kans. 67060

[21] Appl. No.: 202,643

[22] Filed: Oct. 31, 1980

[51] Int. Cl.[3] ..... A47C 4/00

[52] U.S. Cl. ..... 297/19; 297/30; 297/35

[58] Field of Search ..... 297/16, 18, 19, 29, 297/30, 35

[56] References Cited

U.S. PATENT DOCUMENTS

| | | | |
|---|---|---|---|
| 271,596 | 2/1883 | Browne | 297/19 |
| 849,584 | 4/1907 | Van Valkenburg | 297/29 |
| 1,963,708 | 6/1934 | Marvin | 297/35 X |
| 2,344,729 | 3/1944 | Ralston | 297/29 X |
| 2,520,094 | 8/1950 | Hand | 297/19 |

FOREIGN PATENT DOCUMENTS

| | | | |
|---|---|---|---|
| 1106630 | 7/1955 | France | 297/19 |
| 375466 | 6/1932 | United Kingdom | 297/19 |

*Primary Examiner*—Francis K. Zugel
*Attorney, Agent, or Firm*—Edward L. Brown, Jr.

[57] ABSTRACT

A lightweight portable dental examining chair constructed from a series of panels hingedly joined in triangular patterns to form a rigid structure with an adjustable position backrest and a pair of sling-like armrests. A single horizontal adjustment on the base of the chair varies the tilt angle of the backrest while retaining the head of the patient in the same relative horizontal position.

10 Claims, 7 Drawing Figures

FOLDABLE DENTAL CHAIR

BACKGROUND OF THE INVENTION

The present invention relates to a foldable and readily portable dental examining chair. Not since the early history of dentistry has there been a market for foldable dental examining chairs. With the advent of the specialty fields of dentistry such as orthodontics and others, the concept of satellite clinics has come into being wherein specialists will travel to smaller cities setting up a temporary office for a day or more a month. Since these short periods of practice would not justify stationary fully-equipped offices, the portable concept has become economically feasible.

The patent to Browne (U.S. Pat. No. 271,596) illustrates the concept of a foldable dental chair, however, the overall structure is quite different and very complex as compared with the present invention. Practically all foldable chairs, such as the patent to Ralston (U.S. Pat. No. 2,344,729), Van Valkenburg (U.S. Pat. No. 849,584) and the above-mentioned Browne patent; all utilize a basic "cross" design in the side frame of the chair. This side frame "cross" basically folds about its center with the seat and back members moving in a variety of different manners, as clearly exemplified in the above-mentioned patents.

SUMMARY OF THE INVENTION

The design of the present invention is not a "cross" design, but rather forms a triangular shape with the backrest, seat and seat support panel, all of which tilt together about the supporting point of the backrest on the base member. As the backrest is reclined, the support point on the base member is moved forward which allows the chair to not only tilt backwards, but also move forward in the same motion so that the head of the patient retains a relatively constant horizontal position at different angular positions of the backrest. The sling-type armrests are removably fastened to the sides of the seat, with the upper ends connected to the sides of the headrest, so that with the armrests under tensile load, they assist in carrying the cantilevered load on the backrest of the chair, thereby contributing to the structural stability of the overall structure. Since the upper connecting points of the armrests are set inwardly from the outer edge of the chair, the upper portions of the slings also support the patient's shoulders, as well as their arms.

Due to the very simplified geometry of the present invention, there is a single adjustment to vary the backrest angle along with the height of the patient's head.

Therefore, the principal object of the present invention is to provide a portable dental chair which is relatively simple in design and adjustment while being extremely strong and rigid.

Another object of the present invention is to provide a lightweight foldable dental chair which is readily collapsed to a relatively compact size.

These and other important objects and advantages of the present invention will be more specifically set forth in, and will become apparent from the following detailed description of the preferred embodiment of the invention when read in conjunction with the accompanying drawings, wherein.

Figure 1:
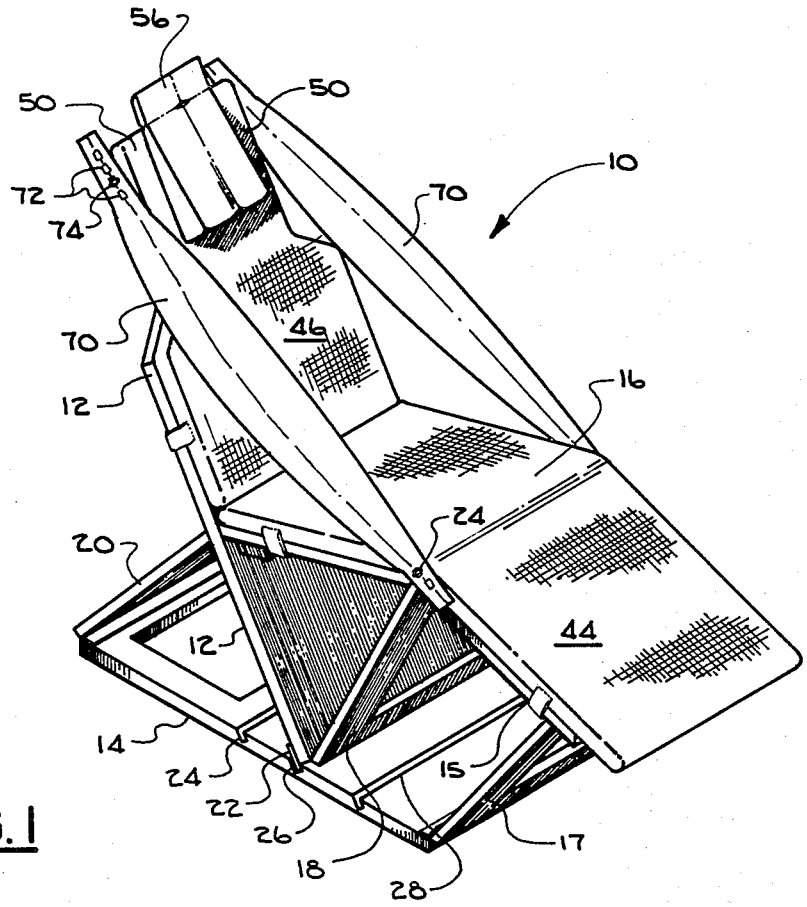
FIG. 1 is a perspective side elevational view of the dental chair in its set-up position.
Figure 2:
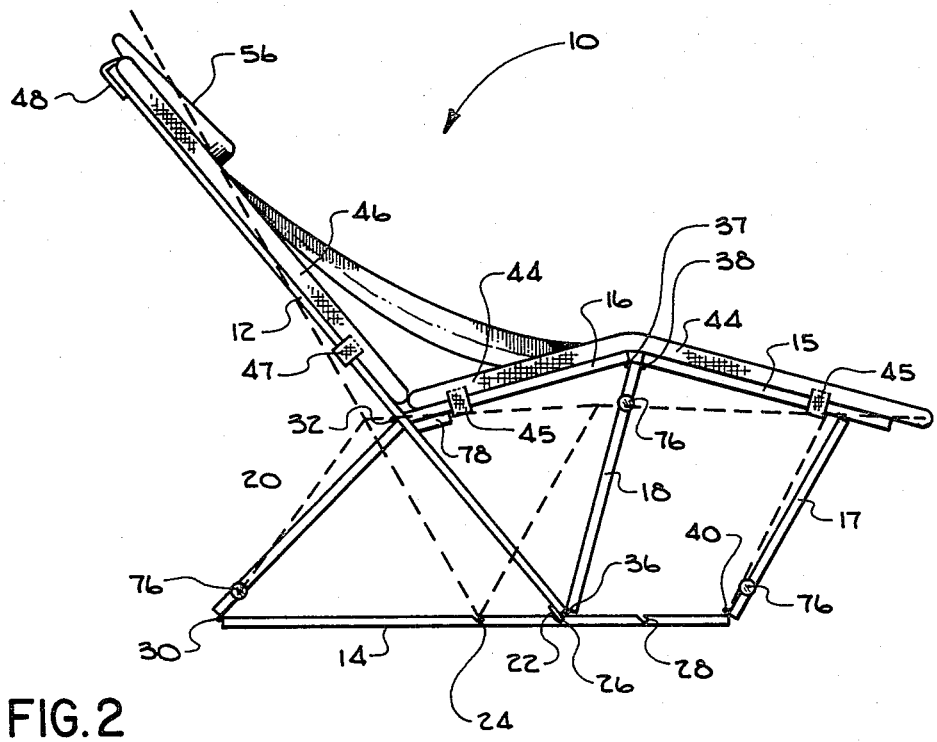
FIG. 2 is a side elevational view of the chair in a similar position as shown in FIG. 1, with a second position of the backrest shown in dotted line.

Turning now more particularly to FIGS. 1 and 2, the overall dental examining chair will be generally referred to by reference numeral 10. The chair 10 is made up from a series of planar panels hingedly connected together, which in its assembled position, as seen in FIG. 2, provides a series of rigid triangular structures. The panels of the chair include backrest member 12, base 14, seat 16, seat support panel 18, and a backrest support panel 20. Along the bottom edge of backrest 12 is a metal bar 22 which adjustably engages any one of slots 24, 26 and 28, depending upon the backrest position desired. Backrest support panel 20 is hingedly connected to both base 14 and backrest 12 by hinges 30 and 32, respectively. Seat 16 releasably engages backrest 12 by a series of dowel pins 34 (see FIG. 5) which engage mating openings in the front surface of backrest 12 while the outer end of seat 16 is hingedly connected to seat support panel 18. Panel 18, in turn, is hingedly connected to the bottom end of backrest 12 by hinge 36. While seat 16 is hingedly connected to one side of support panel 18 by hinge 37, leg rest 15 is hingedly connected to the opposite side of panel 18 by hinge 38. Leg rest 15 is in turn supported by leg rest support panel 17 which is hingedly connected at its lower end to base 14 by hinge 40. Support panel 17 includes a plurality of dowel pins 42 (see FIG. 5) extending longitudinally therefrom which engage a series of openings in the underside of leg rest 15, not shown in the drawing.

Removably attached to the seat 16 and leg rest 15, is a cushion 44 which is held in place by a series of flaps 45 which fold around the sides of the seat 16, and leg rest 15, and engage Velcro strips fixed on the bottoms thereof. A second backrest cushion 46 covers the backrest 12 with the exception of the headrest area and is held in place by flaps 47 which fold around the sides of the backrest 12, and flaps 48 which fold over the top edge thereof.

Figure 3:
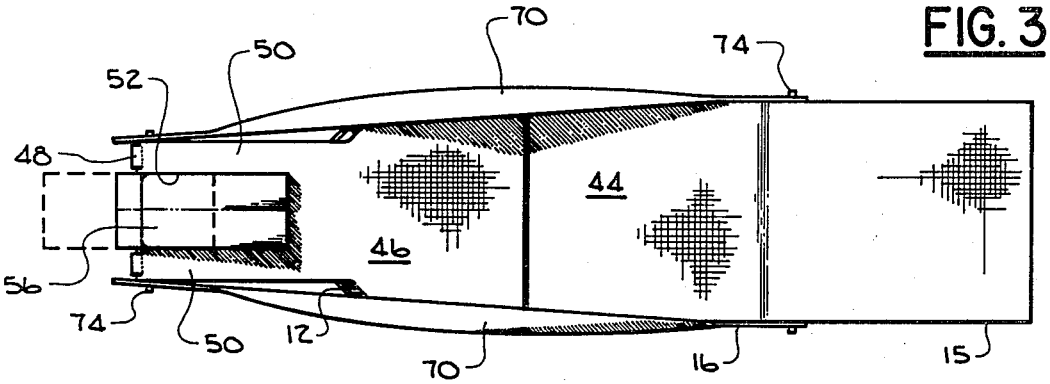
FIG. 3 is a top plan view of the chair with the adjustable positions of the headrest shown in dotted line.
Figure 4:
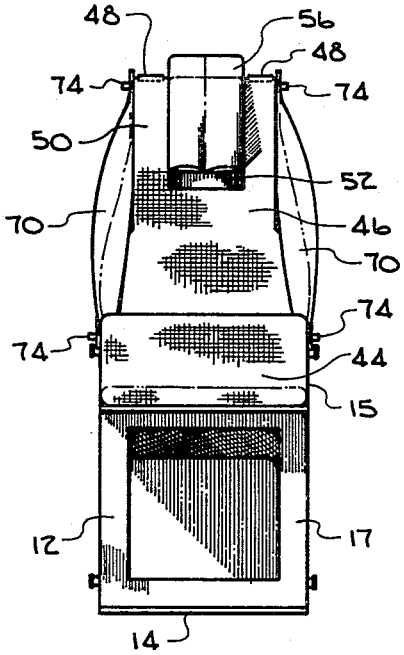
FIG. 4 is a front elevational view of the chair in its FIG. 1 position.

Backrest 12 includes an upper portion 50 which has a reduced width, as best seen in FIGS. 1 and 3. Centrally disposed in the upper portion 50 of the backrest 12 is a slot 52 which slidably receives a headrest member 54 which in turn is covered by a wedge-shaped cushion 56, as shown in detail in FIGS. 6 and 7. Attached to the cushion 56 is a double flap 58 whose ends 60 and 62 are fastened to the back surface of headrest 54 by Velcro strips 64. Cushion 56 is formed with a crease 74 down the center thereof (see FIG. 7), to help position the patient's head. The relative longitudinal position of cushion 56 on headrest 54 can be adjusted through the shifting of the ends 60 and 62 on flap 58.

Releasably attached to both sides of the chair 10 are a pair of armrests in the form of flexible slings 70 which have a slightly cupped cross section for retention of the patient's arms and shoulders. Slings 70 are attached to the upper end of the backrest 12 on opposite sides of the headrest cushion 56. The slings 70 include a series of attachment openings 72, so that the tension in the sling can be varied to fit different sized people. Releasable fastening means 74 are located on the sides of the upper portion of the backrest 12 and the front sides of seat 16 for releasable engagement with the slings.

Figure 5:
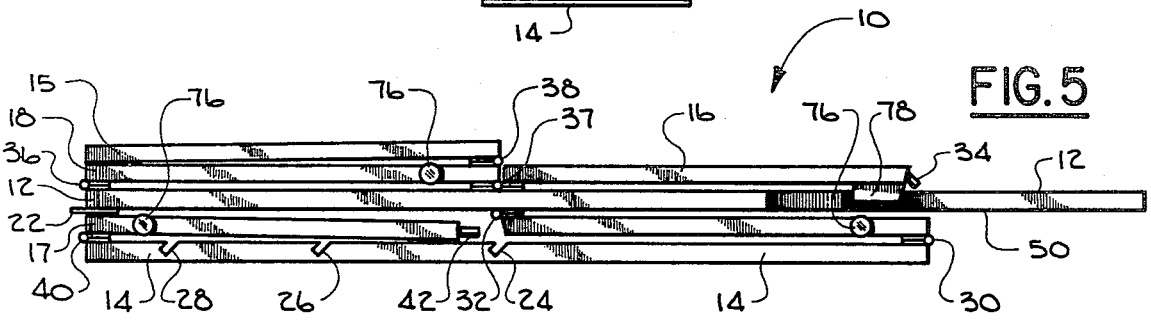
FIG. 5 is a side elevational view of the chair in its folded state.

Located along each side of the chair 10 are three adjustable supporting feet 76, which are best seen in FIG. 5. When the chair is in its folded condition, it is carried on its side with the weight resting on the feet 76 so as to lift the cushions and panels of the chair off the ground. Located on the rear underside of seat 16 is a reinforcing block 78 which assists in distributing the stress loading on adjacent portions of the chair.

While the particular material the chair is made from is not critical to the invention, hardwoods appear to be the preferred material from an aesthetic sense. The various planar panels could likewise be constructed of lightweight metal such as tubular aluminum or a bonded composite panel having a honeycomb core.

The chair 10 is shown in its folded form in FIG. 5 with all of the panels in a compact stack. The chair in its folded form is easily carried by a handle strap, not shown in the drawing, which merely loops both ends of the folded panels. The chair 10 constructed of hardwood is easily carried by one person with an overall weight of approximately 50 pounds.

The chair is assembled in a matter of seconds with the engaging bar 22 on the backrest 12 engaging one of the slots or notches 24, 26 and 28 in the base member 14. The seat member 16 is then folded back forming a triangle shape with the support panel 18 with the dowel pins 34 engaging mating openings in the backrest 12. The height of the patient's head can be adjusted by tilting the backrest 12 further back or forward by engaging a different notch with bar 22. As the angle of the backrest is lowered towards the horizontal, the bottom portion of the backrest is moved horizontally forward so as to minimize horizontal change in the patient's head position. This is a particularly important advantage in dentistry since the patient's head must be uniformly distant from the dental unit in all positions of the chair.

Figure 6:
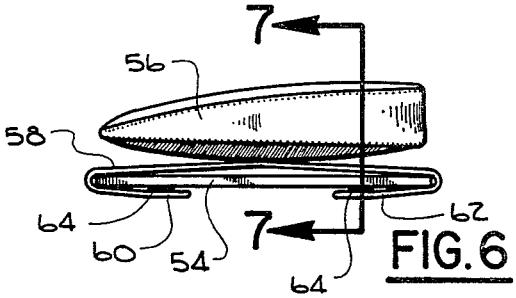
FIG. 6 is an enlarged side elevational view of the headrest and pillow.
Figure 7:
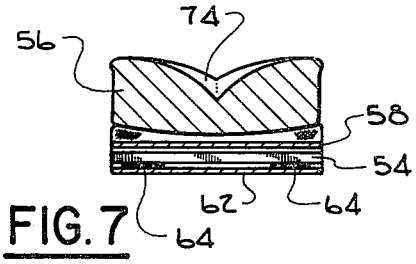
FIG. 7 is a sectional view taken along line 7—7 of FIG. 6.

The armrests or slings 70 are unique in that they attach to the upper end of the backrest 12 spaced inwardly from the normal width of the chair. This allows the sling member 70 to not only contain the patient's arms but also contact the shoulders of the patient. As the weight on the armrests 70 is increased, the cantilever loading on the backrest 12 is diminished due to the tensile support from sling 70. Headrest cushion 56 is invertible and adjustable up and down with varying thicknesses on the pillow so as to vary the angular position of the head of the patient with respect to his body. Further cushion adjustment can be obtained by removing end flaps 60 and 62 from headrest member 54, and sliding the cushion 56 forward or backwards, as seen in FIG. 6.

The horizontal adjustment feature of notches 24, 26 and 28 can be replaced by a reversible motor driven screw mounted on base 14 which engages and retains the bottom edge of backrest 12.

Having described the invention with sufficient clarity to enable those skilled in the art to make and use it, what is claimed as new and desired to be secured by Letters Patent is:

1. A foldable dental examining chair comprising:

a planar base member which supports the overall chair including adjustment means horizontally spaced on the base member;

a planar backrest member having disengageable attachment means at its lower end for engaging the adjustment means;

a backrest support panel pivotally attached at one end approximate the rear end of the base member and at the opposite end pivoted to the backrest;

a planar seat member removably attached to the front side of the backrest approximate its midpoint;

a seat support panel pivotally attached at one end to the front of the seat member and pivotally attached at the opposite end to the backrest, forming a rigid triangle with the seat and backrest, the attachment means on the backrest is engageable with various notches allowing the backrest and seat to be tilted toward the horizontal while at the same time moved forward so that the head of the patient in the various positions of the chair remains in the approximately same relative horizontal position.

2. A dental examining chair as set forth in claim 1, including armrest means on the sides thereof comprising a pair of flexible slings, the upper ends of each attached to the backrest approximate its upper end and the lower ends of said slings attached to the front sides of the seat member.

3. A dental examining chair as set forth in claim 1, wherein the backrest includes an upper portion which has a reduced width and armrest means comprising a pair of flexible slings, the upper ends of each removably attached to the upper portion of the backrest with the lower ends of the slings attached approximate the front of the seat member.

4. A dental examining chair as set forth in claim 1, wherein the backrest includes an upper portion which has a reduced width and an adjustable headrest which slides longitudinally therein, and armrest means comprising a pair of flexible slings, the upper ends of each removably attached to the upper portion of the backrest and the lower ends of said slings removably attached to the front sides of the seat member.

5. A dental examining chair as set forth in claim 1, wherein the backrest includes an upper portion with a reduced width and an adjustable headrest which slides longitudinally therein, and a wedge-shaped invertible cushion removably attached to the headrest having a crease down the center thereof.

6. A dental examining chair as set forth in claim 1, including a planar leg rest pivotally attached to the front of the seat member, and a leg rest support panel pivotally attached at one end to the base member with the opposite end removably attached to the leg rest.

7. A foldable dental examining chair comprising:

a planar base member which supports the overall chair including adjustment notches horizontally spaced on the base member;

a planar backrest member having disengageable attachment means at its lower end for engaging the adjustment notches;

a backrest support panel pivotally attached at one end approximate the back of the base member and at the opposite end pivoted to the backrest;

a planar seat member removably attached to the front side of the backrest approximate its midpoint;

a seat support panel pivotally attached at one end to the front of the seat member and pivotally attached at the opposite end to the backrest forming a rigid triangle with the seat and backrest, the attachment means on the backrest is engageable with various notches allowing the backrest and seat to be tilted toward the horizontal while at the same time moved forward so that the head of the patient in the various positions of the chair remains in the same relative horizontal position;

a planar leg rest pivotally attached to the front of the seat member; and a leg rest support panel pivotally attached at one end to the base member with the opposite end removably attached to the leg rest.

8. A dental examining chair as set forth in claim 7, wherein the leg rest includes a series of longitudinally spaced engagement openings on the underside thereof for different engaging positions by said leg rest support so as to vary the angle of the leg rest to the seat.

9. A dental examining chair as set forth in claim 7, including armrest means on the sides thereof comprising a pair of flexible slings, the upper ends of each attached to the backrest approximate its upper end and the lower ends of said slings attached to the front sides of the seat member.

10. A dental examining chair as set forth in claim 7, wherein the backrest includes an upper portion which has a reduced width and armrest means comprising a pair of flexible slings, the upper ends of each removably attached to the upper portion of the backrest with the lower ends of the slings attached approximate the front of the seat member.

* * * * *